United States Patent [19]

Abel et al.

[11] 4,219,332

[45] Aug. 26, 1980

[54] PROCESS FOR DYEING WOOL OR WOOL/SYNTHETIC BLENDS

[75] Inventors: Heinz Abel, Reinach; Charles Soiron, Riehen, both of Switzerland

[73] Assignee: Ciba-Geigy Corporation, Ardsley, N.Y.

[21] Appl. No.: 946,998

[22] Filed: Sep. 29, 1978

[30] Foreign Application Priority Data

Sep. 29, 1977 [CH] Switzerland ..... 11907/77
Jun. 6, 1978 [CH] Switzerland ..... 6176/78

[51] Int. Cl.[2] ..... D06P 3/82

[52] U.S. Cl. ..... 8/532; 8/533; 8/554; 8/566; 8/585; 8/685; 8/917

[58] Field of Search ..... 8/21 R, 42 R, 42 B, 8/43, 54, 17, 22, 84

[56] References Cited

U.S. PATENT DOCUMENTS

| | | | |
|---|---|---|---|
| 1,693,926 | 12/1928 | Horsfall et al. | 8/54 |
| 2,422,586 | 6/1947 | Royer et al. | 8/43 |
| 2,963,513 | 12/1960 | Albrecht | 8/54 |
| 3,529,922 | 9/1970 | Berger et al. | 8/54 |
| 4,120,647 | 10/1978 | Lawton et al. | 8/17 |

FOREIGN PATENT DOCUMENTS

| | | |
|---|---|---|
| 769718 | 1/1972 | Belgium . |
| 134272 | 1/1972 | Netherlands . |
| 1523294 | 8/1978 | United Kingdom . |

*Primary Examiner*—A. Lionel Clingman
*Attorney, Agent, or Firm*—Edward McC. Roberts

[57] ABSTRACT

A process for dyeing wool or wool/synthetic blends with 1:1 metal complex dyes or acid metal-free wool dyes from a strongly acid aqueous bath, which comprises dyeing said material in the presence of (a) a quaternization product of a polyalkylene oxide adduct of a fatty amine containing at least 16 carbon atoms and 15 to 100 moles of alkylene oxide, and (b) a free or etherified N-methylolurea or N-methylolmelamine.

32 Claims, No Drawings

PROCESS FOR DYEING WOOL OR WOOL/SYNTHETIC BLENDS

The present invention provides a novel process for dyeing wool or wool/synthetic blends with 1:1 metal complex dyes or acid metal-free wool dyes from stongly acid aqueous baths.

At the present time, good levelness, penetration and non-barriness are obtained in dyeing wool or wool/synthetic blends, especially in dyeing piece goods, for example closely woven worsted fabric, by using in particular 1:1 metal complex dyes or also metal-free acid wool dyes for dyeing from a sulfuric acid bath, by themselves or in combination. To obtain these advantageous effects, it is usually necessary to employ about 8% of sulfuric acid, based on the weight of the wool. This results in damage to the wool fibre. The damage is just acceptable using normal dyeing times of, for example, 90 minutes and healthy wool. In actual practice, however, it is unsually necessary to shade repeatedly in order to obtain conformity of shade, so that dyeing times of, for example, 3 hours are quite usual. In addition, the wool to be dyed is already damaged to a greater or lesser extent by the pretreatment.

A new process has now been found which makes it possible to obtain level dyeings with minor damage to the fibre.

Accordingly, the present invention provides a process for dyeing wool or wool/synthetic blends with 1:1 metal complex dyes or acid metal-free wool dyes from an acid aqueous bath, which comprises dyeing said material in the presence of (a) a quaternisation product of a polyalkylene oxide adduct of a fatty amine containing at least 16 carbon atoms and 15 to 100 moles of alkylene oxide such as ethylene oxide or propylene oxide, and (b) a free or etherified N-methylolurea or N-methylolmelamine.

As component (a) there is advantageously used a quaternisation product of a polyglycol ether derivative of a fatty amine containing at least 16 carbon atoms, said product containing 15 to 100, in particular 30 to 100, $$-CH_2\underset{\underset{X}{|}}{C}HO- \quad \text{groups,}$$

wherein X represents hydrogen or methyl.

The component (a) is preferably a quaternisation product of a polyglycol ether derivative of the formula $$R-N\begin{cases}(\underset{\underset{X_1}{|}}{C}H-\underset{\underset{X_2}{|}}{C}H-O-)_m-H \\ (\underset{\underset{X_3}{|}}{C}H-\underset{\underset{X_4}{|}}{C}H-O-)_n-H\end{cases} \quad (1)$$

wherein R represents an aliphatic hydrocarbon radical of 16 to 24 carbon atoms, each of $X_1$, $X_2$, $X_3$ and $X_4$ represents hydrogen or one of the symbols of the pair of substituents $X_1/X_2$ and/or $X_3/X_4$ represents methyl, and m and n are integers, the sum of which is 15 to 100 in particular 30 to 100.

The quaternisation products used as component (a) are obtained by methods which are in themselves known by, for example, addition of 15 to 100 moles of ethylene oxide or, alternately, in any order, ethylene oxide and propylene oxide, to a fatty amine containing at least 16 carbon atoms, and subsequent quaternisation of the adducts.

Particularly suitable components (a) are quaternisation products of polyglycol ether derivatives of the formula $$R-N\begin{cases}(CH_2-CH_2-O-)_m-H \\ (CH_2-CH_2-O-)_n-H\end{cases} \quad (2)$$

wherein R, m and n have the given meanings. R is preferably an alkyl or alkenyl radical of 16 to 24 carbon atoms.

These products are obtained by introducing polyglycol ether chains into primary monoamines which contain an aliphatic hydrocarbon radical containing at least 16 carbon atoms, preferably with the aid of ethylene oxide, in a manner which is in itself known, until the reaction product contains an average of 15 to 100, preferably 30 to 100, $-CH_2-CH_2-O-$ groups, and subsequently quaternising the adducts.

As starting materials there are used, for example, aliphatic primary monoamines with unsaturated or saturated, branched or especially unbranched, hydrocarbon radicals. Good results are obtained, for example, with amines of the formula $$H_3C-(CH_2)_n-NH_2$$

wherein n is an integer with a value of at least 19, for example 19 or 21. Because they can be more readily obtained, it is generally advantageous to use alkylamines with unbranched hydrocarbon chain containing an even number of carbon atoms.

As examples of amines which are suitable starting materials for the process of the present invention there may be mentioned: palmitylamine, stearylmine, arachidylamine, behenylamine, lignocerylamine and montanylamine, and also eruchinylamine and brassidylamine.

Mixtures of fatty amines which contain at least 10%, and advantageously at least 20%, of amines having at least 20 carbon atoms, and up to 90% of primary aliphatic monoamines having less than 20 carbon atoms, are also suitable starting materials for the process of the invention.

Suitable starting materials are furthermore mixtures of fatty amines of higher molecular weight containing at least 10% of fatty amines whose carbon chain contains at least 20 carbon atoms. Such mixtures of fatty amines can be obtained, for example, from suitable natural fats or oils having a content, corresponding to the above condition, of fatty acids containing at least 20 carbon atoms, by converting the fatty acids obtained therefrom by saponification into the corresponding fatty acid amides or fatty acid nitriles, for example with ammonia, and subsequently subjecting these to catalytic hydrogenation. Examples of natural fats and oils suitable for the above purpose are colza oil, and also marine fish oils, for example whale oil, codliver oil, menhaden oil and sardine oil.

The reaction of these nitrogen-containing compounds with the ethylene oxide is carried out in conventional known manner, advantageously at elevated temperature and excluding atmospheric oxygen, and desirably in the presence of suitable catalysts, for example small amounts of alkali metal, alkali metal hydroxide, alkali metal carbonate or alkali metal acetate. Particularly suitable polyglycol ether derivatives are obtained by reaction with an amount of ethylene oxide such that the reaction product contains an average of 15 to 100 $—CH_2—CH_2—O—$ groups.

The polyglycol ether derivatives are quaternised with conventional quaternising agents, such as alkyl halides, for example methyl iodide, methyl chloride, methyl bromide or ethyl chloride; halocarboxamides, for example chloroacetamide; alkyltoluenesulfonates, for example methyl p-toluenesulfonate; ethylene chlorohydrin, ethylene bromohydrin, epichlorohydrin or epibromohydrin; aralkyl halides, such as benzyl chloride or haloalkyl nitriles such as chloroacetonitrile; but especially dialkyl sulfates containing 1 to 2 carbon atoms in each alkyl moiety, such as dimethyl sulfate or diethyl sulfate.

A preferred component (a) has the formula

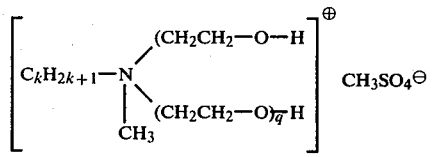

(3)

wherein k is an integer from 20 to 22 and the sum of p and q is 30, or has the formula

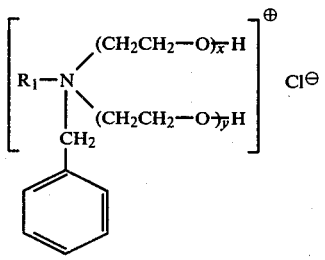

(4)

wherein the sum of x and y is 35 and $R_1$ represents the hydrocarbon radical of tallow fatty amine. Tallow fatty amine is a mixture of 30% of hexadecylamine, 25% of octadecylamine and 45% of octadecenylamine.

Component (b) is preferably a free or etherified N-methylolurea. Such a compound can be both an acyclic and preferably a cyclic N-methylolurea in etherified or preferably unetherified form.

The etherified products are in particular lower alkyl ethers containing, for example, 1 to 4 carbon atoms in the alkyl moiety, such as the n-butyl, isobutyl, isopropyl, n-propyl, ethyl and, especially, methyl ethers. Both completely etherified and only partly etherified products are possible.

Preferred N-methylolureas are those of the formula

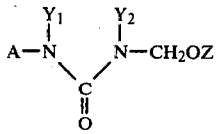

(5)

wherein A represents hydrogen, alkyl of 1 to 4 carbon atoms or $—CH_2OZ_1$, each of $Y_1$ and $Y_2$ represents hydrogen, alkyl of 1 to 4 carbon atoms, or $—CH_2OZ_2$, or $Y_1$ and $Y_2$ together represent alkylene of 2 or 3 carbon atoms, 1,2-dihydroxyethylene, 2-hydroxypropylene, 1-methoxy-2-dimethylpropylene,

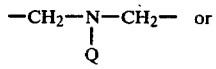

or

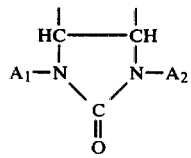

(5a)

each of Z, $Z_1$ and $Z_2$ represents hydrogen or alkyl of 1 to 4 carbon atoms and Q represents hydrogen, alkyl or hydroxyalkyl, each of 1 to 4 carbon atoms, and each of $A_1$ and $A_2$ has the meaning given for A. The cyclic N-methylolurea compounds are preferred.

Suitable N-methylolureas are for example derivatives of urea, ethylene urea, propylene urea, acetylene diurea of dihydroxyethylene urea, and also urone or triazone derivatives. As specific compounds there may be cited: N,N-dimethylolurea, N,N'-dimethylolurea dimethyl ether, N,N'-tetramethylolacetylene diurea, N,N'-dimethylolpropyleneurea, 4,5-dihydroxy-N,N'-dimethylolethyleneurea, 4,5-dihydroxy-N,N'-dimethylolethyleneurea dimethyl ether, N,N'-dimethylol-5-hydroxypropyleneurea, 4-methoxy-5,5-dimethyl-N,N'-dimethylolpropyleneurea, N,N'-dimethylol-5-oxapropyleneurea and, in particular, N,N'-dimethylolethyleneurea. The cyclic urea compounds can also in some cases be in the form of oligo-condensation products. Mixtures of these acyclic and cyclic urea compounds can also be used.

Alkyl in the definition of A, $Y_1$, $Y_2$, Z, $Z_1$, $Z_2$ and Q in formulae (5) and (5a) is for example n-butyl, isobutyl, n-propyl, isopropyl, in particular ethyl and most particularly methyl.

Particularly suitable N-methylolureas are those of the formula

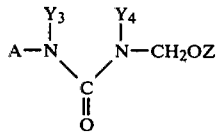

(6)

wherein each of $Y_3$ and $Y_4$ represents hydrogen, alkyl of 1 to 4 carbon atoms, $—CH_2OZ_2$, or $Y_3$ and $Y_4$ together represent alkylene of 2 or 3 carbon atoms or 1,2-dihydroxyethylene, and A, Z, $Z_1$ and $Z_2$ have the given meanings.

Preferred N-methylolureas are those of the formula

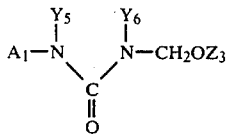

(7)

wherein $A_1$ represents hydrogen, methyl, ethyl, —$CH_2OH$ or $CH_2OCH_3$, each of $Y_5$ and $Y_6$ represents hydrogen, methyl, ethyl or —$CH_2OH$ or $Y_5$ and $Y_6$ together represent ethylene, 1,2-dihydroxyethylene or 2-hydroxypropylene and $Z_3$ represents hydrogen or methyl. The unetherified N-methylolureas of formula (7) are preferred.

Good results are obtained in particular with cyclic N-methylolureas of the formula

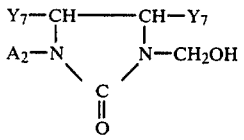

(8)

wherein $Y_7$ represents hydrogen or hydroxyl and $A_2$ represents hydrogen or preferably —$CH_2OH$, or in particular with N,N'-dimethylolethyleneurea.

A free or etherified N-methylolmelamine can also be used as component (b). This compound preferably has the formula

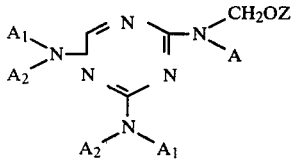

(9)

wherein A, $A_1$, $A_2$ and Z have the given meanings. Examples of suitable N-methylolmelamines are dimethylolmelamine, trimethylolmelamine, tetramethylolmelamine, hexamethylolmelamine, hexamethylolmelaminepentamethyl ether or pentamethylolmelamine di- or trimethyl ether, hexamethylolmelamine hexamethyl ether or hexaethyl ether.

The N-methylolureas and N-methylolamines to be used according to the invention are known and are obtained by known methods.

The weight ratio of component (a) to component (b) is advantageously between 1:1 and 1:6, preferably between 1:2 and 1:4.

Dyebaths which contain a quaternised polyglycol ether derivative of the formula (3) as component (a) and N,N'-dimethylolethylene urea as component (b) are especially preferred.

The amounts in which the components (a) and (b), based on their solids content, are added to the dyebaths, vary between 0.5 and 10% by weight, preferably between 1 and 6% by weight, based on the weight of the goods to be dyed. Components (a) and (b) can be added to the dyebath separately or together in the form of an aqueous preparation. In this latter case, the solids content of the components (a) and (b) together is about 30 to 50% by weight.

The fibrous material which can be dyed by the process of the invention comprises in particular wool by itself or wool/polyamide or especially wool/polyester blends.

The fibrous material can be in a a very wide variety of process stages, for example in the form of yarns, flocks, slubbing, knitted goods, nonwovens or preferably wovens.

Suitable polyester material is in particular fibrous material from linear polyesters which are obtained for example by polycondensation of terephthalic acid with ethylene glycol or of isophthalic acid or terephthalic acid with 1,4-bis-(hydroxymethyl)cyclohexane, or are copolymers of terephthalic and isophthalic acid and ethylene glycol.

The dyes are for example salts of 1:1 metal complex dyes or of metal-free wool dyes for dyeing from a sulfuric acid bath. These dyes can belong to the most diverse classes, for example monoazo, disazo or polyazo dyes including formazane dyes and also anthraquinone, xanthene, nitro, triphenylmethane, naphthoquinonimine and phthalocyanines dyes. The dyes preferably contain acid, salt-forming substituents, such as carboxylic acid groups, sulfuric acid ester or phosphonic acid ester groups, phosphonic acid groups or sulfonic acid groups. They can also contain in the molecule reactive groups which form a covalent bond with the wool constituent to be dyed.

The 1:1 metal complex dyes are of especial interest. These preferably contain one or two sulfonic acid groups. As metal, they contain a heavy metal atom, for example copper, nickel or, in particular, chromium. The 1:1 metal complex dyes can be used, if desired, in mixtures with one another or with the acid metal-free wool dyes.

The amount of dye added to the dyebath depends on the desired colour strenght; in general, amounts of 0.1 to 10% by weight, based on the weight of the fibrous material, have proved useful.

The dyebaths additionally contain mineral acids, in particular sulfuric acid and optionally also phosphoric acid, organic acids, advantageously lower aliphatic carboxylic acids, such as formic, acetic or oxalic acid. The acids are used for adjusting the pH value of the dyebaths. The pH value is usually 1.5 to 3, preferably 1.9 to 3 and especially 2 to 2.5.

The dyebaths can additionally contain the conventional electrolytes, levelling agents, wetting agents and antifoams. If desired, the components (a) and (b) can be dissolved in water together with a wetting agent, for example a mixture of a fatty alkylsulfonate, a fatty alkylpolyglycol ether and a silicone antifoam, before the addition to the dyebath.

The wool or wool/synthetic blends is advantageously dyed by the exhaust method. The liquor ratio can be chosen within a wide range, for example from 1:4 to 1:100, preferably from 1:10 to 1:50.

The process of the invention can be carried out for example in the temperature range between 60° and 130° C., preferably between 80° and 120° C. The dyeing can also be carried out only at boiling temperature, for example between 60° and 106° C., especially between 85° and 102° C. A preferred temperature range for dyeing the wool is also that from 106° to 130° C., preferably 110° to 120° C. When the dyeing is complete, the bath is cooled to about 60° C. and the dyed material is rinsed and dried in the conventional manner.

The dyeing time can vary, depending on the requirements, but is usually from 60 to 120 minutes. On raising the temperature, for example up to 120° C., the dyeing time can be only 15 to 45 minutes, which corresponds to an 83 to 50% reduction in the conventional dyeing time of 90 minutes.

The dyeing process of the invention yields level and strong dyeings which are also distinguished by good fastness tc rubbing and good colour yields. In particular, a marked protection of the wool is obtained both on employing longer dyeing times under conventional temperature conditions and in the high temperature range, in which connection the important fibre properties of wool, such as tensile strength, burst strength and elongation, are retained. In addition, the other properties of the dyeings, for example light- and wetfastness, are not affected.

Compared with the conventional method of dyeing at 98° to 106° C., the process of the invention affords the further advantage of a reduction in the dyeing time at higher temperature without damage to the wool.

The invention is illustrated by the following Examples, in which the parts and percentages are by weight.

EXAMPLE 1

The following assistant mixture is prepared:

300 g of the polyglycol ether derivative of the formula (3)

1125 g of N,N'-dimethylolethyleneurea 25 g of an adduct of 5 moles of ethylene oxide with 1 mole of 2-ethylhexanol 75 g of an anionic surfactant, for example a sulfonated fatty amine polyglycol ether, and 2225 g of water.

Dyeing is carried out with the following dyestuff mixture:

125 g of the dye of the formula (101)

498 g of the dye of the formula (102)

995 g of the dye of the formula (103)

1145 g of the dye of the formula (104)

(101)

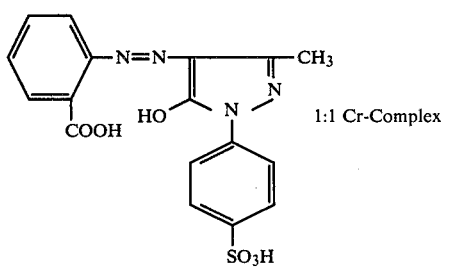

(102)

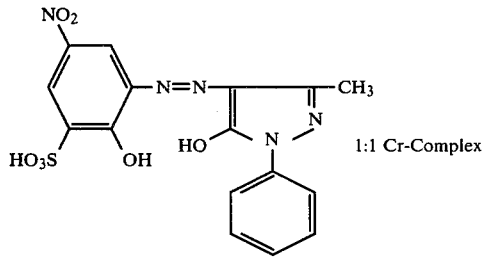

(103)

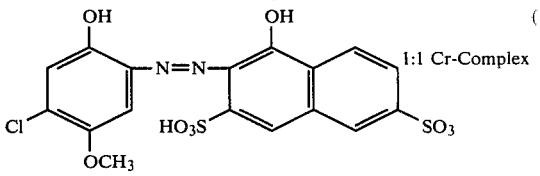

-continued (104)

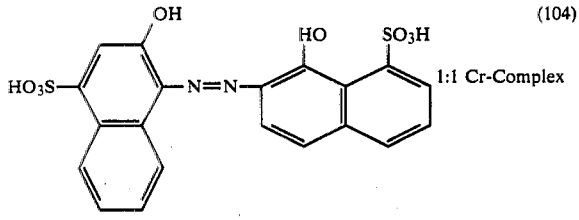

124 kg of worsted yarn are dyed as follows in a beam dyeing machine at a liquor ratio of 1:12 and a pH value of 2.2. The goods are prewetted for 10 minutes at 60° C. and then 5600 g of 96% sulfuric acid and 3750 g of the above assistant mixture are added. The dissolved dye is added after a further 10 minutes. The dyebath is heated to boiling temperature in the course of 25 minutes and dyeing is carried out at the boil for 90 minutes. The bath is subsequently cooled by introducing cold water and the goods are rinsed. A level, dove blue dyeing is obtained. Repetition of the above procedure, but without addition of the assistant mixture, results in an unlevel, barry dyeing.

A level dyeing is also obtained by dyeing with a dyebath which contains 8% of sulfuric acid, but without the assistant mixture. However, marked damage to the fabric occurs. The solubility in alkali serves as index of the damage to the fabric.

| Bath ingredients based on the weight of the wool | pH value at start/ | conclusion | Solubility in alkali % | Levelness and barriness |
|---|---|---|---|---|
| 8% of sulfuric acid | 2,0 | 2,2 | 37,8 | level |
| 4,5% of sulfuric acid | 2,2 | 2,5 | 25,3 | un level barry |
| 4,5% of sulfuric acid 3% of assistant mixture | 2,2 | 2,5 | 19,4 | level |

EXAMPLE 2

100 kg of woollen fabric are wetted in 1000 liters of water in a beam dyeing machine. The bath is then heated to 70° C. and the following ingredients are added in dissolved form with constant liquor circulation:

1500 g of hexamethylolmelamine hexamethyl ether, 1000 g of a polyglycol ether derivative of the formula (3), 4500 g of 96% sulfuric acid and 1500 g of the 1:1 chromium complex dye Acid Green 12, C.I. 13425.

The dyebath is heated in the course of 30 minutes to 110° C. and the wool is dyed for 30 minutes at this temperature. The bath is then cooled and the wool is rinsed and dried. A level dyeing is obtained. The loss in burst strength of the wool is only 9%.

Repetition of the above procedure, but without addition of the polyglycol ether derivative of the formula (3), results in an unlevel dyeing.

If dyeing is carried out with a dyebath of the same composition which does not contain the hexamethylolmelamine hexamethyl ether, then distinct damage to the fabric occurs with a 20.5% loss in burst strength.

A level green dyeing is obtained by substituting the same amount of hexamethylolmelamine hexaethyl ether for hexamethylolmelamine hexamethyl ether in the dye liquor.

EXAMPLE 3

100 kg of woollen fabric are heated to 70° C. in 400 liters of water on a high temperature winch beck. The following ingredients are then added to the dyebath:

5000 g of 96% sulfuric acid,
600 g of a polyglycol ether derivative of the formula (4),
3000 g of N,N'-dimethylolethyleneurea,
800 g of the 1:1 chromium complex of the dye of the formula (104) and
600 g of Acid Blue 40, C.I. 62125.

The dyebath is heated to 120° C. in the course of 40 minutes and the wool is dyed for 30 minutes at this temperature. The dyebath is then cooled and the wool is rinsed and dried. A level blue dyeing is obtained. The loss in burst strength of the wool is 12.7%.

Repetition of the above procedure, but without addition of the polyglycol ether derivative of the formula (4), results in an unlevel dyeing. If dyeing is carried out with a dyebath which contains the normal amount of 8000 g of 96% sulfuric acid instead of only 5000 g, then the dyestuff combination cannot be used.

Damage to the fibre occurs with a 24% loss in burst strength by dyeing with a liquor which does not contain the N,N'-dimethylolethyleneurea.

EXAMPLE 4

100 kg of wool carpet yarn are heated to 60° C. in 1200 liters of water in a cheese dyeing machine. The following ingredients are then added with constant liquor circulation:

6000 g of 96% sulfuric acid
500 g of a polyglycol ether derivative of the formula

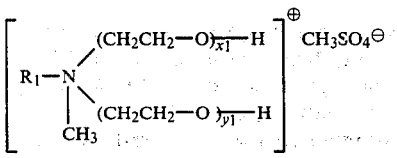

(10)

(wherein $R_1$ is the hydrocarbon radical of tallow fatty amine and the sum of $x_1+y_1$ is 20)

1000 g of N,N'-dimethylolethylene urea,
2000 g of the 1:1 chromium complex dye Acid Red 183, C.I. 18000 and
300 g of the 1:1 chromium complex of the dye of the formula (102).

The dyebath is heated in the course of 30 minutes to 85° C. and the wool is dyed for 90 minutes at this temperature. The bath is then cooled and the wool is rinsed and dried. A level, red dyeing is obtained.

Repetition of the above procedure, but without addition of the polyglycol ether derivative of the formula (10), results in an unlevel dyeing. Repetition of the above procedure, but without addition of N,N'-dimethylolethyleneurea, results in a dyeing with a distinctly more brittle handle.

EXAMPLE 5

A level green dyeing is also obtained by repeating the procedure described in Example 2, but using instead of the polyglycol ether derivative of the formula (3) 1000 g of a polyglycol ether derivative of the formula

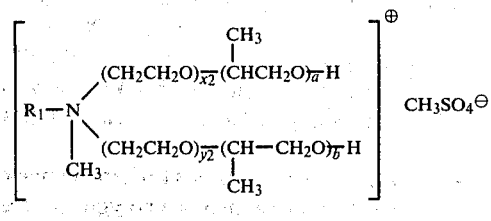

(11)

wherein $R_1$ is the hydrocarbon radical of tallow fatty amine and the sum of $x_2+y_2$ is 30 and the sum of a+b is 8.

What is claimed is:

1. A process for dyeing wool or wool/synthetic blends with 1:1 metal complex dyes or acid metal-free wool dyes from an acid aqueous bath, which comprises dyeing said material in the presence of (a) a quaternisation product of a polyalkylene oxide adduct of a fatty amine containing at least 16 carbon atoms and 15 to 100 moles of alkylene oxide, and (b) a free or etherified N-methylolurea or N-methylolmelamine.

2. A process according to claim 1 wherein dyeing is carried out in a dyebath having a pH of 1.5 to 3.

3. A process according to claim 2 wherein dyeing is carried out in a dyebath having a pH of 1.9 to 3.

4. A process according to claim 1 wherein dyeing is carried out at a temperature of 60° to 130° C.

5. A process according to claim 4 wherein dyeing is carried out a temperature of 80° to 120° C.

6. A process according to claim 4 wherein dyeing is carried out at a temperature of 60° to 106° C.

7. A process according to claim 4 wherein the dyeing of wool is carried out at 110° to 120° C.

8. A process according to claim 1 wherein the dyebath contains the components (a) and (b) together in an amount of 0.5 to 10% by weight, based on the weight of the fibrous material.

9. A process according to claim 1 wherein the weight ratio of component (a) to component (b) is 1:1 to 1:6.

10. A process according to claim 1 wherein dyeing is carried out with 1:1 metal complex dyes.

11. A process according to claim 1 wherein component (a) is a quaternisation product of a polyglycol ether derivative of a fatty amine having at least 16 carbon atoms, said quaternisation product containing 15 to 100

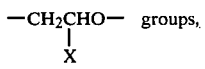

groups, wherein X represents hydrogen or methyl.

12. A process according to claim 1 wherein component (a) is a quaternisation product of a polyglycol ether derivative of the formula.

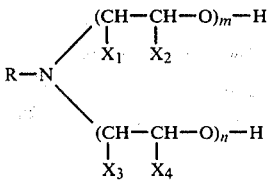

(1)

wherein R represents an aliphatic hydrocarbon radical containing 16 to 24 carbon atoms, each of $X_1$, $X_2$, $X_3$ and $X_4$ represents hydrogen or one of the symbols of the pair of substituents $X_1/X_2$ and/or $X_3/X_4$ represents methyl and m and n integers, the sum of which is 15 to 100.

13. A process according to claim 12 wherein component (a) is a quaternisation product of a polyglycol ether derivative of the formula

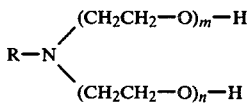

(2)

wherein R, m and n are as defined in claim 12.

14. A process according to claim 13 wherein R represents an alkyl or alkenyl radical of 16 to 24 carbon atoms.

15. A process according to claim 13 wherein the radical R is derived from a fatty amine mixture which contains at least 10% by weight of amines containing at least 20 carbon atoms and up to 90% by weight of amines containing less than 20 carbon atoms.

16. A process according to claim 1 wherein component (a) is a fatty amine/alkylene oxide adduct quaternised with a dialkyl sulfate containing 1 or 2 carbon atoms in each alkyl moiety.

17. A process according to claim 16 wherein component (a) is a quaternisation product of the formula

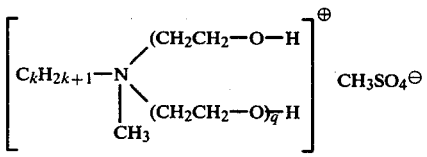

(3)

wherein k is an integer from 20 to 22 and the sum of p+q is 30.

18. A process according to claim 1 wherein component (b) is a free or etherified N-methylolurea.

19. A process according to claim 18 wherein component (b) is a free or etherified cyclic N-methylolurea.

20. A process according to claim 18 wherein component (b) is a N-methylolurea of the formula

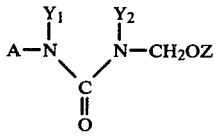

(5)

wherein A represents hydrogen, alkyl of 1 to 4 carbon atoms or $—CH_2OZ_1$, each of $Y_1$ and $Y_2$ represents hydrogen, alkyl of 1 to 4 carbon atoms or $—CH_2OZ_2$, or $Y_1$ and $Y_2$ together represent alkylene of 2 to 3 carbon atoms, 1,2-dihydroxyethylene, 2-hydroxypropylene, 1-methoxy-2-dimethylpropylene, $—CH_2—O—CH_2—$,

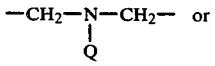

-continued

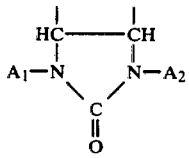

(5a)

each of Z, $Z_1$ and $Z_2$ represents hydrogen or alkyl of 1 to 4 carbon atoms and Q represents hydrogen, alkyl or hydroxyalkyl, each of 1 to 4 carbon atoms, and $A_1$ and $A_2$ have the same meanings as A.

21. A process according to claim 20 wherein component (b) is a N-methylolurea of the formula

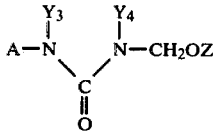

(6)

wherein each of $Y_3$ and $Y_4$ represents hydrogen, alkyl of 1 to 4 carbon atoms or $—CH_2OZ_2$, or $Y_3$ and $Y_4$ together represent alkylene of 2 or 3 carbon atoms or 1,2-dihydroxyethylene, and A, Z, $Z_1$ and $Z_2$ are as defined in claim 20.

22. A process according to claim 20 wherein component (b) is a N-methylolurea of the formula

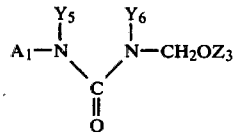

(7)

wherein $A_1$ represents hydrogen, methyl, ethyl, $—CH_2OH$ or $—CH_2OCH_3$, each of $Y_5$ and $Y_6$ represents hydrogen, methyl, ethyl or $—CH_2OH$, or $Y_5$ and $Y_6$ together represent ethylene, 1,2-dihydroxyethylene or 2-hydroxypropylene, and $Z_3$ represents hydrogen or methyl.

23. A process according to claim 22 wherein component (b) is a cyclic N-methylolurea of the formula

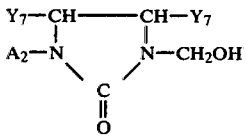

(8)

wherein $Y_7$ represents hydrogen or hydroxyl and $A_2$ represents hydrogen or $—CH_2OH$.

24. A process according to claim 23 wherein component (b) is N,N'-dimethylolethyleneurea.

25. A process according to claim 1 wherein component (a) is a quaternisation product of the formula

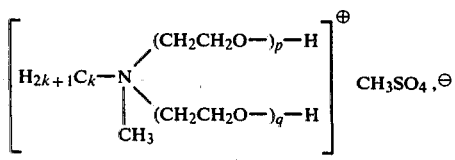

(3)

wherein k is an integer from 20 to 22 and the sum of p+q is 30, and component (b) is N,N'-dimethylolethyleneurea.

26. A process according to claim 1 wherein component (b) is a free or etherified N-methylolmelamine of the formula

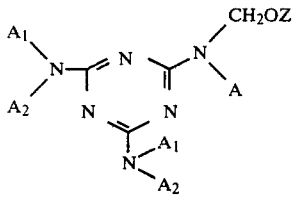

(9)

wherein A, $A_1$, $A_2$ and Z are as defined in claim 20.

27. An aqueous dyebath for dyeing wool or wool/synthetic blends, which contains at least one 1:1 metal complex dye or acid metal-free wool dye and at least (a) a quaternisation product of a polyalkylene oxide adduct of a fatty amine containing at least 16 carbon atoms and 15 to 100 moles of alkylene oxide, and (b) a free or etherified N-methylolurea or a free or etherified N-methylolmelamine.

28. A dyebath according to claim 27 which contains a metal-free wool dye for dyeing from a sulfuric acid bath.

29. An aqueous assistant preparation which contains at least (a) a quaternisation product of a polyalkylene oxide adduct of a fatty amine containing at least 16 carbon atoms and 15 to 100 moles of alkylene oxide, and (b) a free or etherified N-methylolurea or a free or etherified N-methylolmelamine.

30. A preparation according to claim 29 wherein the weight ratio of component (a) to component (b) is 1:1 to 1:6.

31. A preparation according to claim 29 which contains as component (a) a quaternisation product of a polyglycol ether derivative of a fatty amine containing at least 16 carbon atoms, said quaternisation product containing 15 to 100

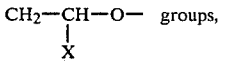

groups, wherein X represents hydrogen or methyl, and, as component (b), a free or etherified N-methylolurea.

32. A preparation according to claim 31 which contains as component (a) a quaternisation product of the formula

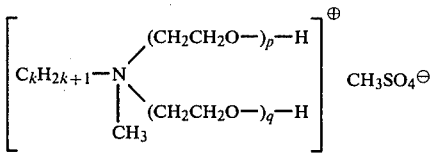

wherein k is an integer from 20 to 22 and the sum of p+q is 30, and, as component (b), N,N'-dimethylolethyleneurea.

* * * * *